United States Patent [19]

Shibata

[11] Patent Number: 4,479,892

[45] Date of Patent: Oct. 30, 1984

[54] AG-METAL OXIDES ELECTRICAL CONTACT MATERIALS

[75] Inventor: Akira Shibata, Yokohama, Japan

[73] Assignee: Chugai Denki Kogyo K.K., Japan

[21] Appl. No.: 494,970

[22] Filed: May 16, 1983

[51] Int. Cl.[3] ..... H01B 1/02

[52] U.S. Cl. ..... 252/514; 252/512; 252/513

[58] Field of Search ..... 252/514, 513, 512; 419/50, 48, 64; 29/874, 875, 879

[56] References Cited

U.S. PATENT DOCUMENTS

| | | | |
|---|---|---|---|
| 3,859,087 | 1/1975 | Backstrom | 252/513 |
| 3,880,777 | 4/1975 | Shibata | 252/519 |
| 3,893,821 | 7/1975 | Davies et al. | 252/514 |
| 3,913,201 | 10/1975 | Schreiner et al. | 252/521 |
| 3,951,872 | 4/1976 | Neely | 252/513 |
| 3,957,453 | 5/1976 | Hüssler et al. | 252/513 |

*Primary Examiner*—Josephine L. Barr

*Attorney, Agent, or Firm*—Shlesinger, Fitzsimmons & Shlesinger

[57] ABSTRACT

Electrical contact materials of a silver base which have dispersed in their silver matrices 2–20 weight % of either one of or combination of fine oxide grains of Sn, Sb, Zn, In, and Bi, and which materials are diffused at their contact surfaces and for moderate depths adjacent thereto with Au, Pd, or alloys thereof, which gradually diminish in diffusion density from the contact surfaces to the moderate depths of the contact materials. The precious metal thus diffused in solid phase about the contact surfaces prevents their chemical aging and improves electrical performance such as anti-weldability, contact resistance, and endurance, without scattering from the contact surfaces or melting deeply all together into the matrices of the contact materials, and further without isolating from and coagulating spherically on the contact surfaces, even when they are subjected to electric arcs.

2 Claims, No Drawings

AG-METAL OXIDES ELECTRICAL CONTACT MATERIALS

BACKGROUND OF THE INVENTION

In order to prevent the lowering of electrical performance of electrical contacts due to oxidation or sulfuration of silver or alloys thereof which form the contact surfaces of the electrical contacts, it has been suggested to have said contact surfaces plated or clad in a thickness of 1–15μ by gold, palladium, or alloys thereof which scarcely react with an environmental gas atmosphere. Such employment is effective for a certain extent when the electric density exerted on contact surfaces is comparatively low. However, when contacts are charged with electric current of a high density and they are exposed to arcs of a high temperature resulting from the opening and closing cycle of the contacts, gold, palladium, or alloys thereof which lie over the contact surfaces are scattered off from said surfaces or melt deeply all together into matrices of contacts, whereby the metals can not perform as well as desired.

Lately, it has been proposed and applied to have silver or silver alloy matrices dispersed with metal oxides such as Sn, Sb, Zn, In, and Bi oxides, so that contacts made therefrom can exhibit, on account of high refractoriness of the metal oxides, high anti-weldability and low-electric contact resistance, even when electric current of a high density is applied thereto. To our disappointment, however, employment of a precious metal of the kind mentioned above for plating or cladding surfaces of the just above-mentioned contacts exhibits little effect or brings forth adverse effects. To wit, since said silver-base contacts which are dispersed with refractory metal oxides are thermally highly stable, and hardly agitate even when their surfaces are subjected to arcs of a high temperature, which are frequently produced particularly at their initial stages of use, and since the more the contact surfaces are thus thermally stable, the more difficult it is to apply gold, palladium, or their alloys to such contact surfaces, because said precious metals are agitated one-sidedly when they are subjected to arcing heat, and they tend to be isolated from and coagulate spherically on the contact surfaces, resulting in the occurrence of undesirable welding of contacts and subsequent inability of making and breaking thereof.

BRIEF SUMMARY OF THE INVENTION

In view of the above, one purpose of this invention is to provide a novel contact material of silver base which contains dispersedly in the silver matrix 2–20 weight % of one of, or a combination of, refractory and fine oxide grains of Sn, Sb, Zn, In, and Bi, and has a contact surface which is plated, coated by evaporation, or clad with a layer of gold, palladium, or their alloys of a thickness of 2–5μ, said precious metal having been diffused into the contact material in solid phase, viz., at a temperature below its melting point, preferably at a temperature of 700°–900° C. and under pressure. Observation by E. D. M. of the electrical contact material made in accordance with this invention shows that the aforementioned precious metal occupies about 20–100 weight % of the contact material at its top surface area, and diffusedly reaches to moderate or middle depths of the material, while reducing its density gradually. Thus, the precious metal which lies at the surface and has been diffused to the moderate depths of the contact, prevents the contact surface from chemical aging such as sulfuration, oxidation, or chlorination thereof, and makes its contact surface stable. Said precious metal does not isolate from the contact surface even at the making and breaking operations with electric arcs. The contact material of this invention can advantageously be employed for the duty under a large electric current as well as under a low electric load, since its contact surface changes smoothly and evenly, with the progress of operation cycles, from a phase which is rich of the precious metal, to a phase where it is consisted of the precious metal, silver, and metal oxides, and then to a phase where it is consisted of silver and metal oxides. It shall be noted also that since the precious metal such as gold and alloys thereof which have diffused to silver matrices of the contact material, wet well with metal oxides which are dispersed in the matrices, the wettability of the metal oxides with silver is consequently improved, whereby the electric resistance of the contact material becomes more stable and its ductility which is of critical significance for shaping the material to a desired form is also improved.

It is of course possible that metal oxides of the kind mentioned above, can be replaced at least in part by Cd grain oxides. It is also possible of course that the contact material of this invention can contain and/or be clad opposite its contact surface with Ag, Cu, Ni, Fe, or their alloys.

EXAMPLES

Example 1 (contact materials powder-metallurgically made by Ag-Sn (8 weight %)

Contact material (1-A)

92 weight % of Ag powder and 8 weight % of oxidized Sn powder, total weight of which is 3 kg., were mixed well in a shaking mill for 24 hours. This mixture was molded, by a rubber press of 0.5 T/cm$^2$, to a billet of 50 mm in diameter and 130 mm in length. The billet was sintered in air at 850° C. for 2 hours. The billet which had been heated in advance to 800° C., was hot-rolled into a plate having a silver back of 0.1 mm in thickness. From the plate, square contacts of 0.5 mm (thickness including the silver back)×4 mm×4 mm were punched out.

Contact material (1-B)

The contacts of the above (1-A) were plated at contact surface thereof with 6μ of 20-karat gold.

Contact material (1-C)

The hot-rolled plate with the silver back of the above (1-A) was plated at its upper surface with 3μ of Au, and then hot-rolled at 850° C. From this plate, contacts of dimensions same to those of the above (1-A) were obtained. The observation by E. D. M. of the contacts showed that their top surfaces were almost all gold, and gold gradually reduced of its density and diffused to about 4.5μ in depth.

Example 2 (contact materials made by internal oxidation of Ag-Sn (7 weight %)-Bi (0.5 weight %) alloy Contact material (2-A)

A sheet of 0.5 mm in thickness of the alloy, Ag-Sn (7%) Bi (0.5%), with a silver back of 0.1 mm thickness was internally oxidized for 8 hours at an oxygen atmosphere of 700° C. of 8 atm. From this sheet, there were obtained contacts of dimensions same to those of the above (1-A).

Contact material (2-B)

The contacts of the above (2-A) were plated at contact surfaces thereof with 6μ of 20-karat gold.

Contact material (2-C)

The internally oxidized sheet of the above (2-A) was plated at its upper surface with 2μ of Au, and then hot-rolled at 850° C. in a hydrogen atmosphere into a thickness of 0.45 mm. There were obtained those square contacts of 0.45 mm (thickness including the silver back)×4 mm×4 mm in which gold was diffused on their upper surfaces and to middle depths.

Example 3 (contact materials made by internal oxidation of Ag-Sn (6 weight %)-In (3 weight %)-Ni (0.2 weight %) alloy Contact material (3-A)

Contacts were made by the steps same to the above (2-A).

Contact material (3-B)

The contacts of the above (3-A) were plated at their contact surfaces with 6μ of 20-karat gold.

Contact material (3-C)

By the employment of the above alloy, viz., Ag-Sn (6%)-In (3%)-Ni (0.2%), contacts were obtained by the steps same to the above (2-C).

Example 4 (contact materials made by internal oxidation of Ag-Cd (10 weight %)-Sn (2 weight %) alloy)

Contact material (4-A)

Contacts were made by the steps same to the above (2-A).

Contact material (4-B)

The contacts of the above (4-A) were plated at their contact surfaces with 6μ of 20-karat gold.

Contact material (4-C)

By the employment of the above alloy, viz., Ag-Cd (10%)-Sn (2%), contacts were obtained by the steps same to the above (2-C).

Example 5 (square contacts of 0.6 mm (thickness)×4 mm×4 mm made from pure silver)

Contact material (5-A)

The contacts as specified above.

Contact material (5-B)

The contacts of the above (5-A) were plated at their contact surfaces with 6μ of 20-karat gold.

Contact material (5-C)

Ag plate of 0.6 mm thickness were plated at one of its surfaces with 2μ of Au, and hot-rolled at 850° C. to 0.45 mm in thickness. From this, contacts of 0.45 mm (thickness)×4 mm×4 mm were obtained.

Among the above-mentioned contact materials, those of (1-A), (2-A), (3-A), (4-A), and (5-A) are conventional. Those of (1-B), (2-B), (3-B), (4-B), and (5-B) are also such ones which were made conventionally by gold-plating the above group of materials, viz., (1-A), (2-A), (3-A), (4-A), and (5-A).

Whereas, those of (1-C), (2-C), (3-C), and (4-C) are those made in accordance with this invention. The contact material (5-C) is given for the sake of comparison, while it is not conventional and, while it is not within the scope of this invention.

All of the above-described contact materials were tested as to their endurance lives, number of occurrence of welding, and contact resistances. The results are given in the following table. As shown in this table, the contact materials made in accordance with this invention are scarcely aged by environmental gas atmospheres, are afforded with excellent anti-weldability, and have low electric contact resistances and long endurance lives.

Tests were made under the following conditions:

Voltage: AC 220 V

Making current: 55 A pf=0.75

Breaking current: 15 A pf=0.9

Time chart: making current (0.1 sec.)—breaking current (1.5 sec.); total cycle (6 sec.)

Make and break frequency: 10 cycles/minute

Endurance: tested up to 200,000 cycles

Contact dimensions: as given in the Examples

Contact pressure: 50 g.

Releasing force: 45 g.

TABLE

| | Endurance lives (ten thousand cycles) | Welding occurrence (times up to one thousand cycles) | contact resistance (mΩ) | | |
|---|---|---|---|---|---|
| | | | Before the tests | After the tests | After subjecting to hydrogen sulfide atmosphere (10 ppm) for 20 hours |
| (1-A) | 14 | 0 | 1.2 | 30 | 70 |
| (1-B) | 12 | 12 | 0.5 | 25 | 1.2 |
| (1-C) | 18 | 0 | 0.7 | 20 | 0.8 |
| (2-A) | 20 | 0 | 0.5 | 12 | 120 |
| (2-B) | 18 | 2 | 0.6 | 18 | 0.8 |
| (2-C) | 20 | 0 | 0.5 | 10 | 0.6 |
| (3-A) | 18 | 2 | 1.5 | 25 | 40 |
| (3-B) | 15 | 24 | 0.4 | 19 | 1.0 |
| (3-C) | 20 | 0 | 0.5 | 10 | 0.6 |
| (4-A) | 8 | 7 | 0.6 | 7.5 | 48 |
| (4-B) | 0.0125 | 125 | 0.6 | 6.5 | 0.6 |
| (4-C) | 12 | 8 | 0.4 | 5.8 | 0.5 |
| (5-A) | 4 | 250 | 0.5 | 4.2 | 120 |
| (5-B) | 0.1 | 285 | 0.4 | 4.7 | 0.7 |
| (5-C) | 7 | 150 | 0.6 | 3.1 | 0.6 |

I claim:

1. Electrical contact materials of a silver base having dispersed in their silver matrices 2 to 20 weight % of fine oxide grains of a metal selected from the group consisting of Sn, Sb, Zn, In, Cd and Bi and mixtures thereof, and having thereon contact surfaces each of which has secured thereon a layer of precious metal selected from the group consisting of gold, palladium, or alloys thereof, each said layer having been diffused under pressure and at a temperature below its melting point and in solid phase into the contact materials so that the precious metal layers extend through said contact surfaces to moderate depths of the associated contact materials, gradually reducing in density as the depth of diffusion increases, and occupying about 20–100 weight % of the contact surfaces of said materials.

2. Electrical contact materials as claimed in claim 1, in which surfaces opposite to the contact surfaces are clad with Fe, Ag, Cu, Ni, or alloys thereof.

* * * * *